US006779680B1

(12) United States Patent
Schwarz

(10) Patent No.: US 6,779,680 B1
(45) Date of Patent: Aug. 24, 2004

(54) MOLDED PLASTIC CONTAINER WITH OPPOSITE EXTERIOR LIFTING ELEMENTS WITH FINGER PROTECTION

(75) Inventor: Stefan H. Schwarz, Orion Township, MI (US)

(73) Assignee: Letica Corporation, Rochester, MI (US)

( * ) Notice: Subject to any disclaimer, the term of this patent is extended or adjusted under 35 U.S.C. 154(b) by 0 days.

(21) Appl. No.: 10/721,390

(22) Filed: Nov. 25, 2003

(51) Int. Cl.[7] ..... B65D 25/30
(52) U.S. Cl. ..... 220/773; 220/760
(58) Field of Search ..... 220/760, 773, 220/774, 775, 776

(56) References Cited

U.S. PATENT DOCUMENTS 3,220,048 A * 11/1965 Wei ..... 220/759
3,861,733 A * 1/1975 Vander Mey ..... 294/33
3,927,812 A * 12/1975 Winters et al. ..... 220/759
4,293,080 A 10/1981 Letica
4,349,119 A 9/1982 Letica
4,429,805 A 2/1984 Letica
4,711,364 A 12/1987 Letica
5,033,635 A 7/1991 Philips
5,402,908 A 4/1995 Warden et al.
5,526,954 A * 6/1996 Georgiadis ..... 220/760
5,875,913 A 3/1999 Letica
6,257,440 B1 * 7/2001 Perkins et al. ..... 220/764
6,588,618 B1 7/2003 Davis

* cited by examiner

*Primary Examiner*—Joseph Man-Fu Moy
(74) *Attorney, Agent, or Firm*—Young & Basile P.C.

(57) ABSTRACT

A molded plastic container having an open top and bail receivers molded integrally into the side wall at opposite positions. The receivers are shaped and sized to act as lifting handles as well as to receive the ends of a wire bail. Flexible finger guards are molded into the interior volumes of the receivers to prevent contact between the fingers and the bail wire.

2 Claims, 4 Drawing Sheets

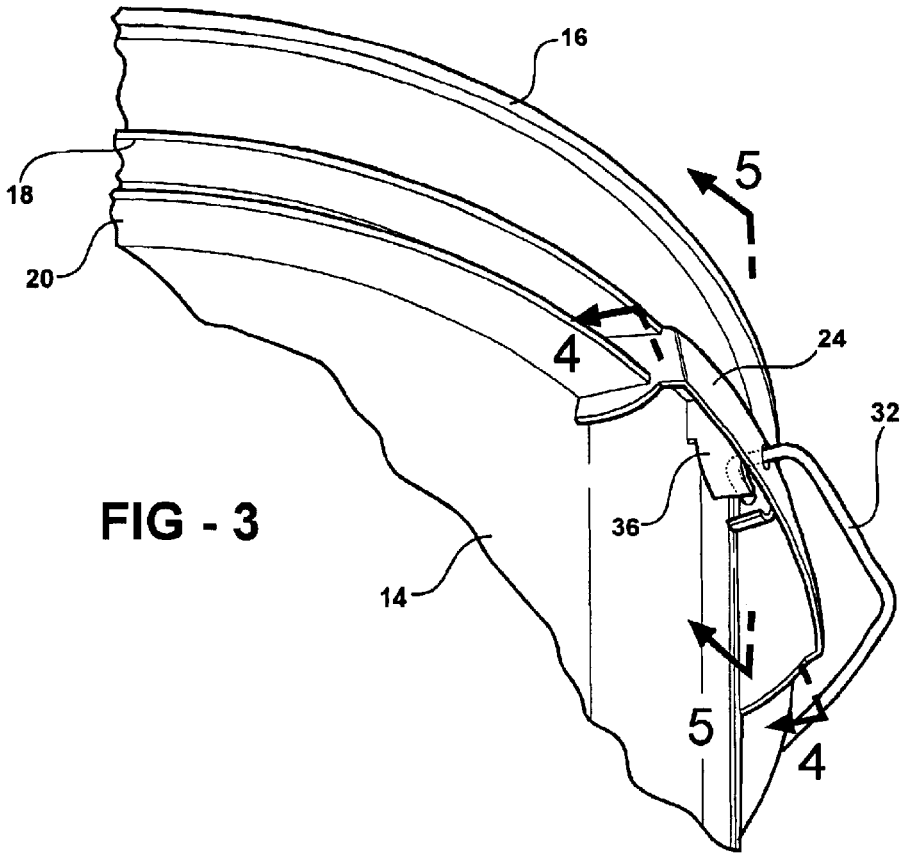
FIG - 3
FIG - 4
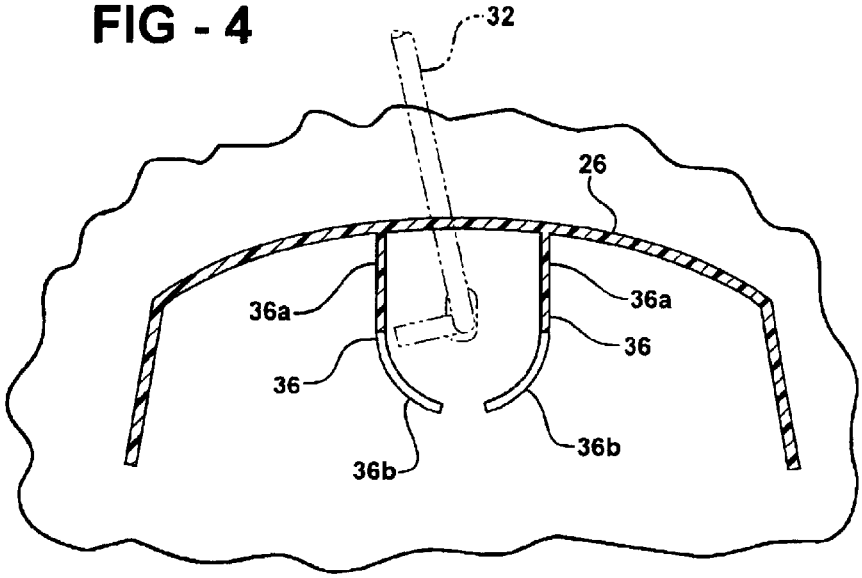

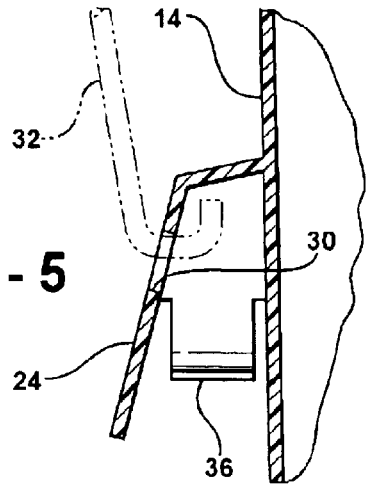
FIG - 5
FIG - 8
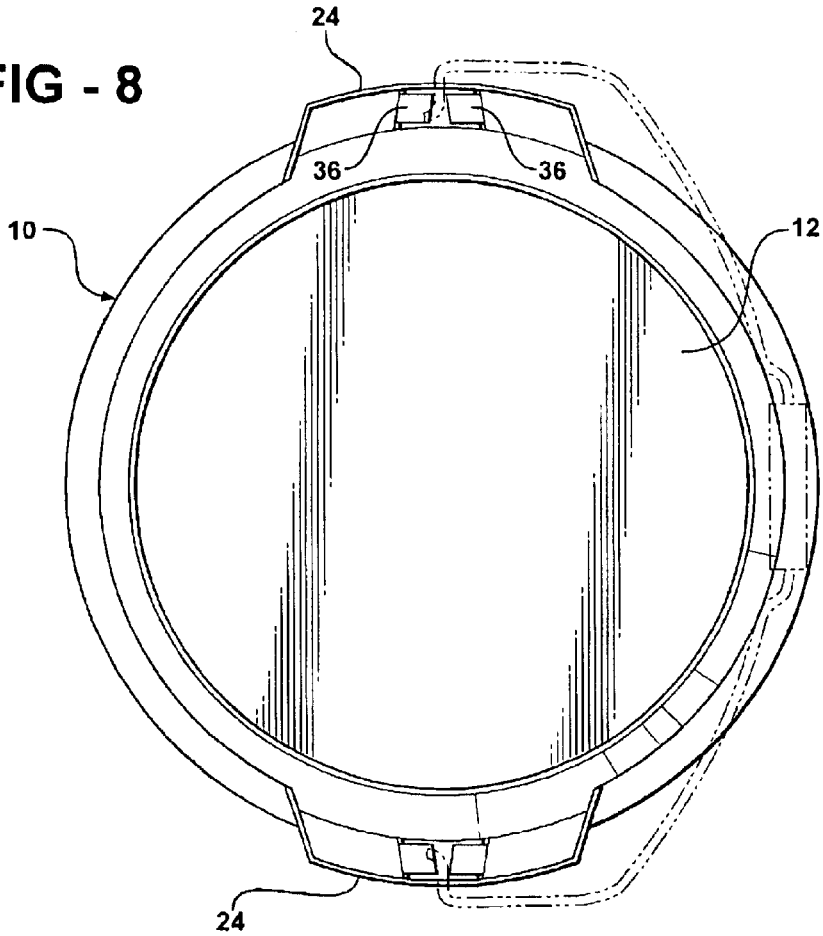

MOLDED PLASTIC CONTAINER WITH OPPOSITE EXTERIOR LIFTING ELEMENTS WITH FINGER PROTECTION

FIELD OF THE INVENTION

This invention relates to molded plastic containers of the type having oppositely located open bottom bail receivers, also serving as lifting handles, and more particularly to the improvement which provides protection against pinched fingers due to inadvertent interference between the bail wire and the user's fingers when lifting the container.

BACKGROUND OF THE INVENTION

Molded plastic containers are commonly and extensively used for the packaging of many materials including, but not limited to, food products, driveway sealant, wallboard dressing and paint. It is common to provide such shipping containers with bails and bail receivers on opposite sides of the container side wall and spaced an inch or more below the open top surface, not only to receive the bail wire, but also to provide lifting handles to assist in moving the containers from place to place. With the bail wire in place, it is possible for the fingers of the person lifting the container to become pinched by inadvertent movement of the bail wire.

SUMMARY OF THE INVENTION

The principal objective of the present invention is to provide guard members in the interior volumes defined by the bail receivers of a molded plastic container so as to guard against and essentially prevent inadvertent pinching of a person's fingers who is using the bail receivers as lifting devices. In general, this is accomplished by providing reversely similar interior guard members depending from the top spacer panel of each bail receiver in oppositely surrounding relationship to the bail aperture through the front panel of the bail receiver.

Further in accordance with the present invention, the guard members described above are configured in such a way as to permit injection molding and more specifically to permit the withdrawal of the portion of the mold or die which is disposed interiorly of the guard members. This is accomplished by forming the lower portions of the guard members to be free of and flexible relative to both the container side wall and the front panels of the bail receivers so that the guard members flex outwardly to permit the interior portion of the molding die to be withdrawn.

Other applications of the present invention will become apparent to those skilled in the art when the following description of the best mode contemplated for practicing the invention is read in conjunction with the accompanying drawing.

BRIEF DESCRIPTION OF THE DRAWING

The description herein makes reference to the accompanying drawing wherein like reference numerals refer to like parts throughout the several views, and wherein:

FIG. 3 is a perspective view into the interior volume of one of the bail receivers showing the guard members therewithin;

FIG. 4 is a detail of a bail receiver with guard members;

FIG. 5 is a side view in section of a bail receiver and container side wall with a bail in place;

FIG. 8 is a bottom view of the container of FIG. 1 with the bail shown in broken lines.

DETAILED DESCRIPTION OF THE PREFERRED EMBODIMENT

Figure 1:
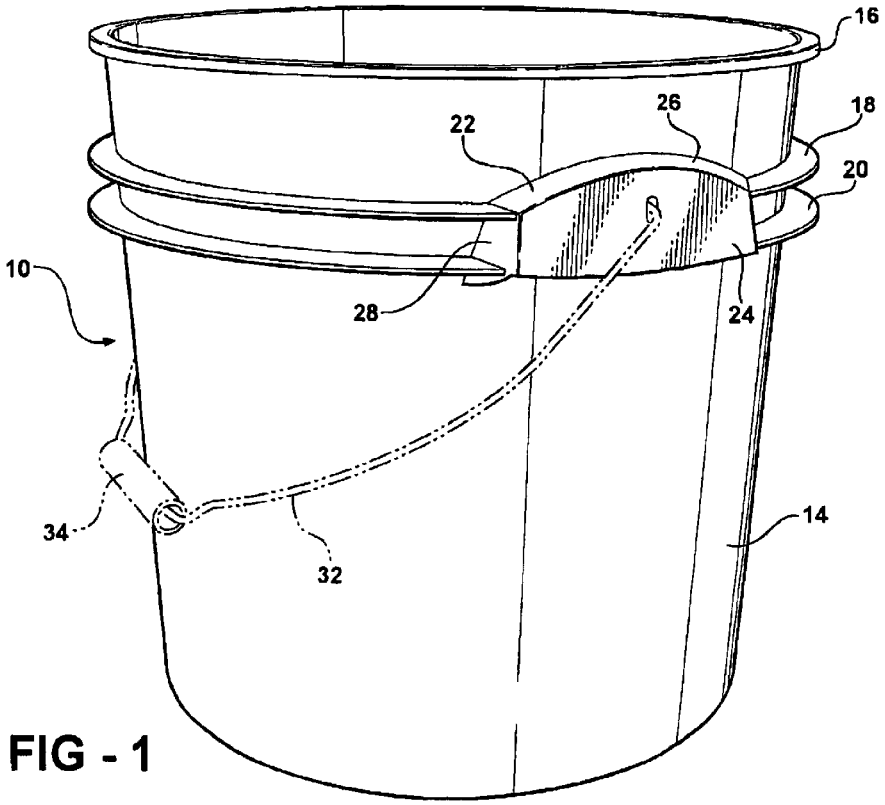
FIG. 1 is a perspective view of an industrial plastic container having opposite bail receivers integral with a pair of spaced parallel circumferential rings.
Figure 2:
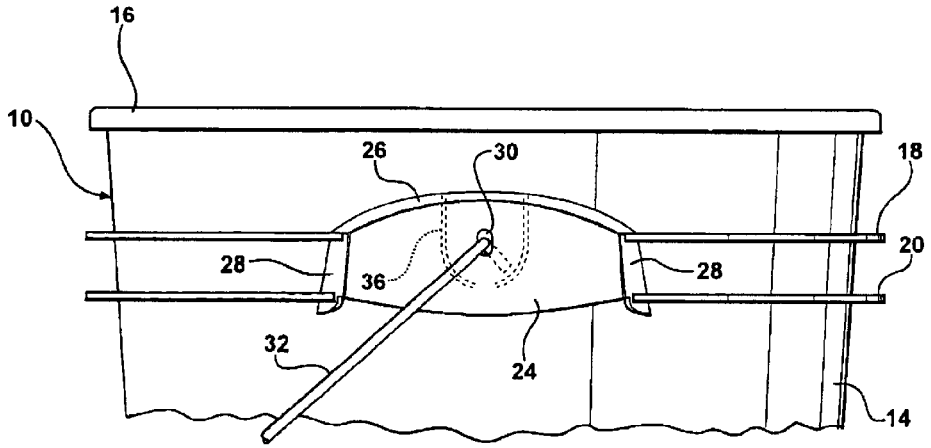
FIG. 2 is a side view of the pail of FIG. 1 showing the interior guard members in dotted lines.

Referring to the drawing, an industrial container 10 is shown to comprise a flat, recessed bottom 12 and a continuous, tapered cylindrical side wall 14 terminating in an open top having a rim 16. The continuous side wall need not be circular in cross section but may be oval, square or rectangular as suits the particular designer. Moreover, the container 10 need not be tapered since the technology is also available to make non-tapered or essentially straight sided injection molded plastic containers.

The container 10 shown in FIG. 1 further comprises integral molded plastic circumferential rings 18 and 20 which are disposed in parallel spaced apart relationship approximately two inches or more below the top rim 16. The rings 18 and 20 add hoop strength as well as aesthetic appeal and are integrated into bail receivers 22, each of which comprises a front panel 24, a top panel 26 and a pair of side panels 28. As a result of the panels 26 and 28, the front panel 24 of the bail receivers 22 stand out in parallel spaced relationship to the side wall 14 at diametrically opposite locations below the peripheral rim 16 but closer to the rim than they are to the bottom. The bail receivers are provided with apertures 30 to receive the hooked ends of a relatively rigid bail wire 32 having a cylindrical molded plastic handle portion 34 mounted thereon.

The size and spacing of the bail receivers 22 is such as to provide not only a location for the insertion of the hooked ends of the bail wire 32, but also to provide lifting handles to facilitate movement of the container 10 from place to place and/or to pour fluid or flowable viscous materials from the interior of the container.

Figure 6:
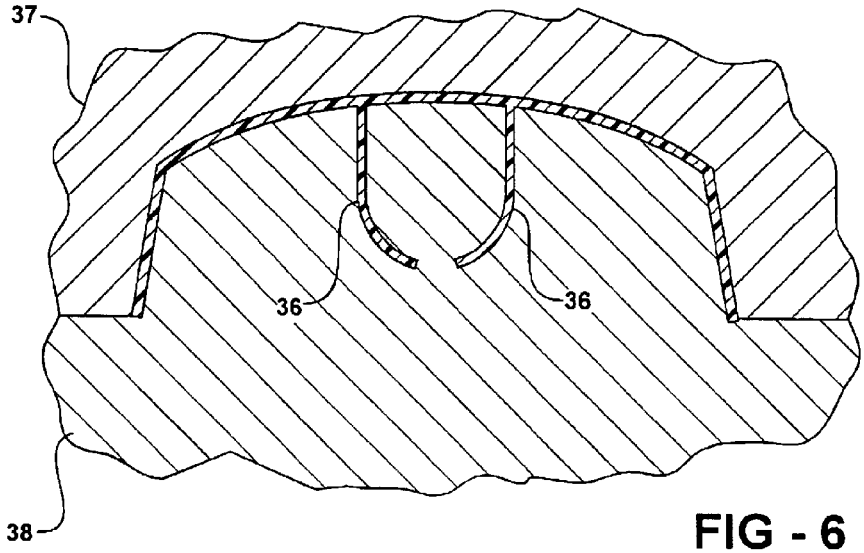
FIGS. 6 and 7 are sectional views of the molding operation used to make the guard members.
Figure 7:
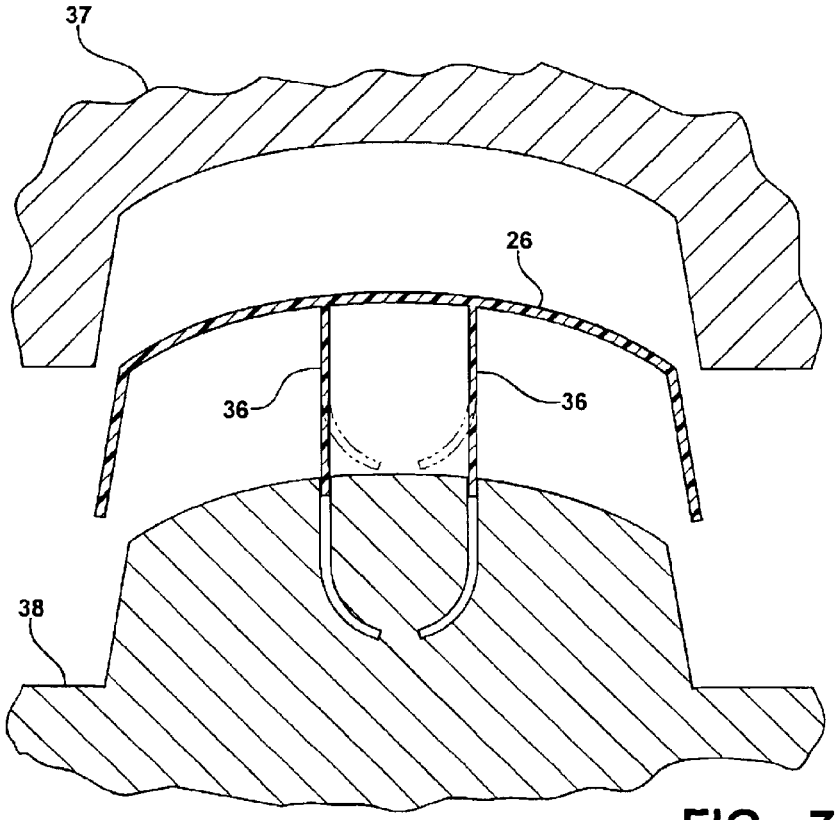

As best shown in FIGS. 2–5, and in accordance with the present invention, guard members 36 are formed integrally with the container 10 within the enclosed volume between the bail receivers 22 and the container side wall 14. The guard members 36 are reversely similar and have straight, parallel top portions 36*a* which are integral with the side wall 14 and front panel 24. In addition, the guard members 36 have inwardly curved bottom portions 36*b* which are spaced from and, therefore, free of both the side wall 14 and front panel 24 so that they may bend outwardly as necessary to pull free of mold 38 as shown in FIGS. 6 and 7. FIG. 6 shows the guard members 36 in the mold 38 and FIG. 7 shows the member being pulled out of the mold cavities as the upper and lower dies 37 and 38 separate. In normal operation, the curved, lower ends of the guard members 36 surround the hooked end of the bail wire 32 and prevent the user from engaging the bail wire 32 with his or her fingers when using the receivers 22 for lifting purposes.

While the invention has been described in connection with what is presently considered to be the preferred embodiment, it is to be understood that the invention is not to be limited to the disclosed embodiment but, on the contrary, is intended to cover various modifications and equivalent arrangements included within the spirit and scope of the appended claims, which scope is to be accorded the broadest interpretation so as to encompass all such modifications and equivalent structures as is permitted under the law. In particular, the shape and appearance of the receivers 22 may be varied according to design taste without loss of function.

What is claimed is:

1. A molded plastic container of the type having a bottom and a continuous side wall terminating in an open top, first and second bail receivers oppositely disposed on and integral with the side wall near but spaced below the open top to also serve as lifting elements, the receivers each comprising a front panel and top and side spacer panels such that the front panel is disposed in spaced parallel relationship to the adjacent side wall and the interior volume between the front panel and the side wall being open to the bottom, and a bail receiving aperture formed in each of said front panels wherein the improvement comprises first and second reversely similar interior guard members depending from the top spacer panel in oppositely surrounding relationship to said aperture, wherein the lower portions of the guard members are free of the side wall and front panel so as to be flexible independently relative thereto.

2. A molded plastic container as defined in claim 1 wherein the reversely similar interior guard members are arcuate over at least the bottom portion thereof and have the free ends in oppositely facing but spaced apart relationship.

* * * * *